US010962907B1

(12) United States Patent
Ishida et al.

(10) Patent No.: US 10,962,907 B1
(45) Date of Patent: Mar. 30, 2021

(54) IMAGE FORMING APPARATUS

(71) Applicant: TOSHIBA TEC KABUSHIKI KAISHA, Tokyo (JP)

(72) Inventors: Kazufumi Ishida, Sunto Shizuoka (JP); Ken Iguchi, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/568,631

(22) Filed: Sep. 12, 2019

(51) Int. Cl.
*G03G 15/16* (2006.01)

(52) U.S. Cl.
CPC ..... *G03G 15/168* (2013.01); *G03G 15/1675* (2013.01)

(58) Field of Classification Search
CPC ..... G03G 15/168; G03G 15/1675
See application file for complete search history.

(56) References Cited

U.S. PATENT DOCUMENTS 5,729,788 A * 3/1998 Hirohashi ..... G03G 15/167 399/101
8,472,817 B2 6/2013 Konishi et al.
2008/0019723 A1* 1/2008 Naganawa ..... G03G 15/168 399/71
2016/0041509 A1* 2/2016 Sekiguchi ..... G03G 15/168 399/66
2016/0131999 A1* 5/2016 Kojima ..... G03G 15/161 399/101
2017/0139352 A1* 5/2017 Sawada ..... G03G 15/161
2018/0059602 A1* 3/2018 Minato ..... G03G 15/5058
2019/0179239 A1* 6/2019 Minato ..... G03G 15/1665

* cited by examiner

*Primary Examiner* — Carla J Therrien
(74) *Attorney, Agent, or Firm* — Foley & Lardner LLP

(57) ABSTRACT

An image forming apparatus includes an image carrier, an exposure device, a developing device, a primary transfer device, a secondary transfer device, and a control unit. The exposure device exposes the image carrier to form an electrostatic latent image on the image carrier. The developing device forms a toner image by developing the electrostatic latent image using toner. The primary transfer device primarily transfers the toner image to a transfer body. The secondary transfer device applies a transfer bias to secondarily transfer the toner image to a recording medium. The control unit applies a cleaning bias to the secondary transfer device to remove residual toner after the secondary transfer. When the control unit determines that the toner image based on the exposed electrostatic latent image is not secondarily transferred at a predetermined timing, the first cleaning processing is performed until the subsequent processing is started.

14 Claims, 6 Drawing Sheets

IMAGE FORMING APPARATUS

FIELD

Embodiments described herein relate generally to an image forming apparatus.

BACKGROUND

In the related art, an image forming apparatus is known in which a toner image formed by a photoconductive drum is primarily transferred onto a transfer body, and a toner image on the transfer body is secondarily transferred onto a sheet. In the secondary transfer, a predetermined bias is applied to a transfer roller, and a toner image is transferred to a sheet passing through the transfer roller. Residual toner that is not transferred to the sheet may be attached to the transfer roller. The residual toner is removed by cleaning processing. The cleaning processing is processing of applying biases having the same polarity and reverse polarity as the toner polarity to a secondary transfer roller, respectively. The cleaning processing is performed in a case where a period for performing the cleaning processing can be secured, for example, in a case where a series of printing operations are completed. For this reason, when the period for performing the cleaning processing cannot be secured, the cleaning processing is not performed. Therefore, in the related art, the residual toner on the transfer roller may not be cleaned efficiently.

DETAILED DESCRIPTION

In general, according to one embodiment, an image forming apparatus includes an image carrier, an exposure device, a developing device, a primary transfer device, a secondary transfer device, and a control unit. The exposure device exposes the image carrier to form an electrostatic latent image on the image carrier. The developing device forms a toner image by developing the electrostatic latent image by using toner. The primary transfer device primarily transfers the toner image to a transfer body. The secondary transfer device applies a transfer bias to secondarily transfer the toner image primarily transferred onto the transfer body to a recording medium. The control unit applies a cleaning bias to the secondary transfer device to perform cleaning processing for removing residual toner after the secondary transfer. When the control unit determines that the toner image based on the exposed electrostatic latent image is not secondarily transferred at a predetermined exposure timing, first cleaning processing is performed until the subsequent processing is started.

Figure 1:
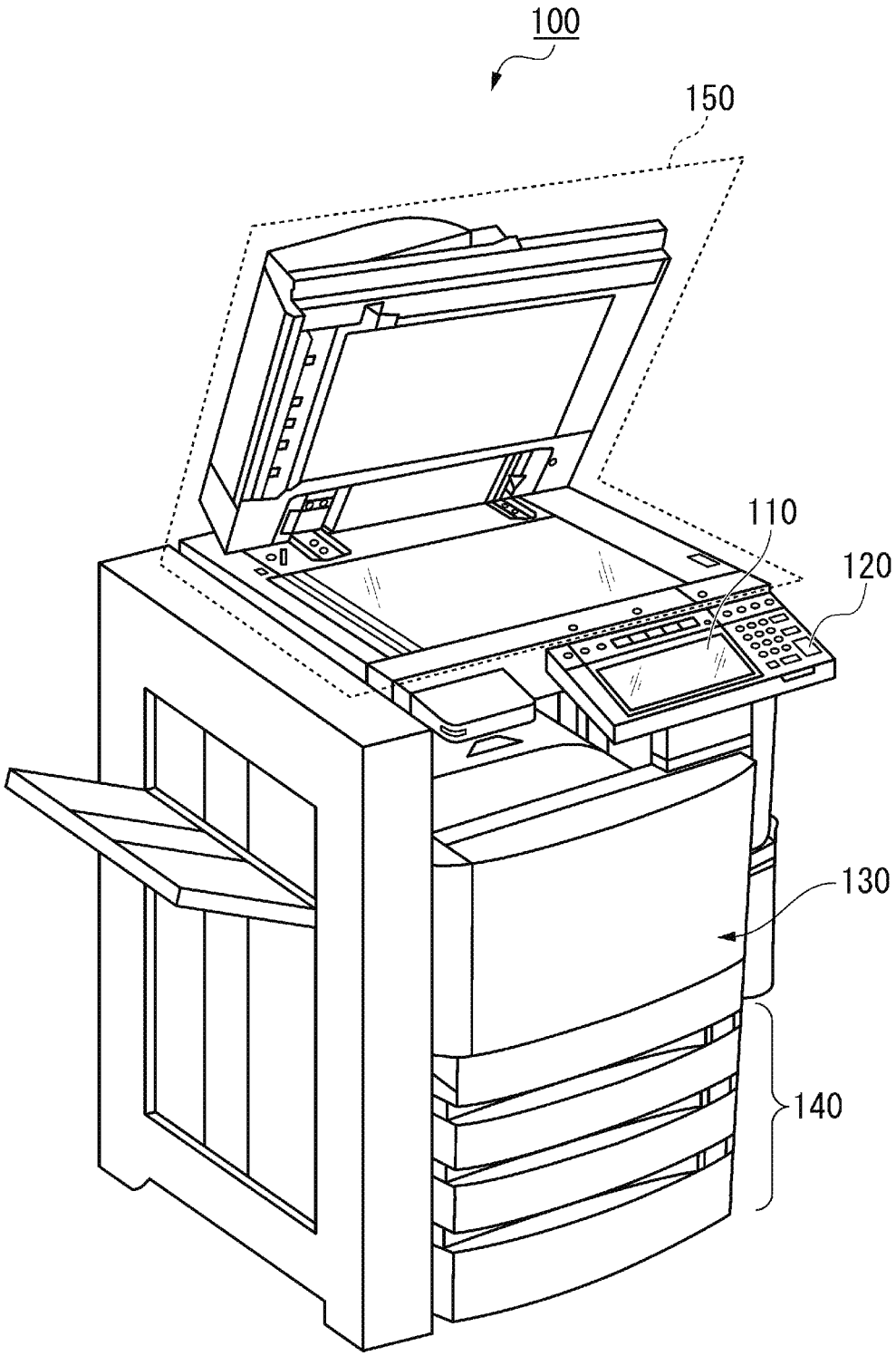
FIG. 1 is an external view showing an overall configuration example of an image forming apparatus according to an embodiment.

FIG. 1 is an external view showing an overall configuration example of an image forming apparatus 100 according to the embodiment. The image forming apparatus 100 is, for example, a multi-function peripheral. The image forming apparatus 100 includes a display 110, a control panel 120, a printer 130, a sheet accommodation unit 140, and an image reading unit 150.

The display 110 is, for example, a liquid crystal display with a touch panel. The display 110 displays various types of information. In addition, the display 110 receives an operation from a user. The display 110 displays various operation screens, an image state, an operation state of each function, and the like according to a display control signal output from the control unit.

The control panel 120 includes various operation keys such as a ten key and a start key. The control panel 120 receives various input operations from the user. Further, the control panel 120 outputs operation signals corresponding to various input operations received from the user to the control unit.

The printer 130 performs a series of printing operations using various information output from the display 110, the control panel 120, the image reading unit 150, and the like. The series of printing operations include an operation of inputting image information, an operation of forming an image, an operation of transferring the formed image to a sheet, an operation of conveying the sheet, and the like.

The sheet accommodation unit 140 includes a plurality of sheet cassettes. Each sheet cassette accommodates sheets.

The image reading unit 150 includes an automatic original document feeder and a scanner. The automatic document feeder feeds an original document placed on a document tray to a scanner. The scanner optically scans an original document on an original document glass table and forms the reflected light from the original document on a light receiving surface of a charge coupled device (CCD) sensor. Thus, the scanner reads an original document image on the original document glass table. The image reading unit 150 generates image information (image data) by using the reading result read by the scanner.

Figure 2:
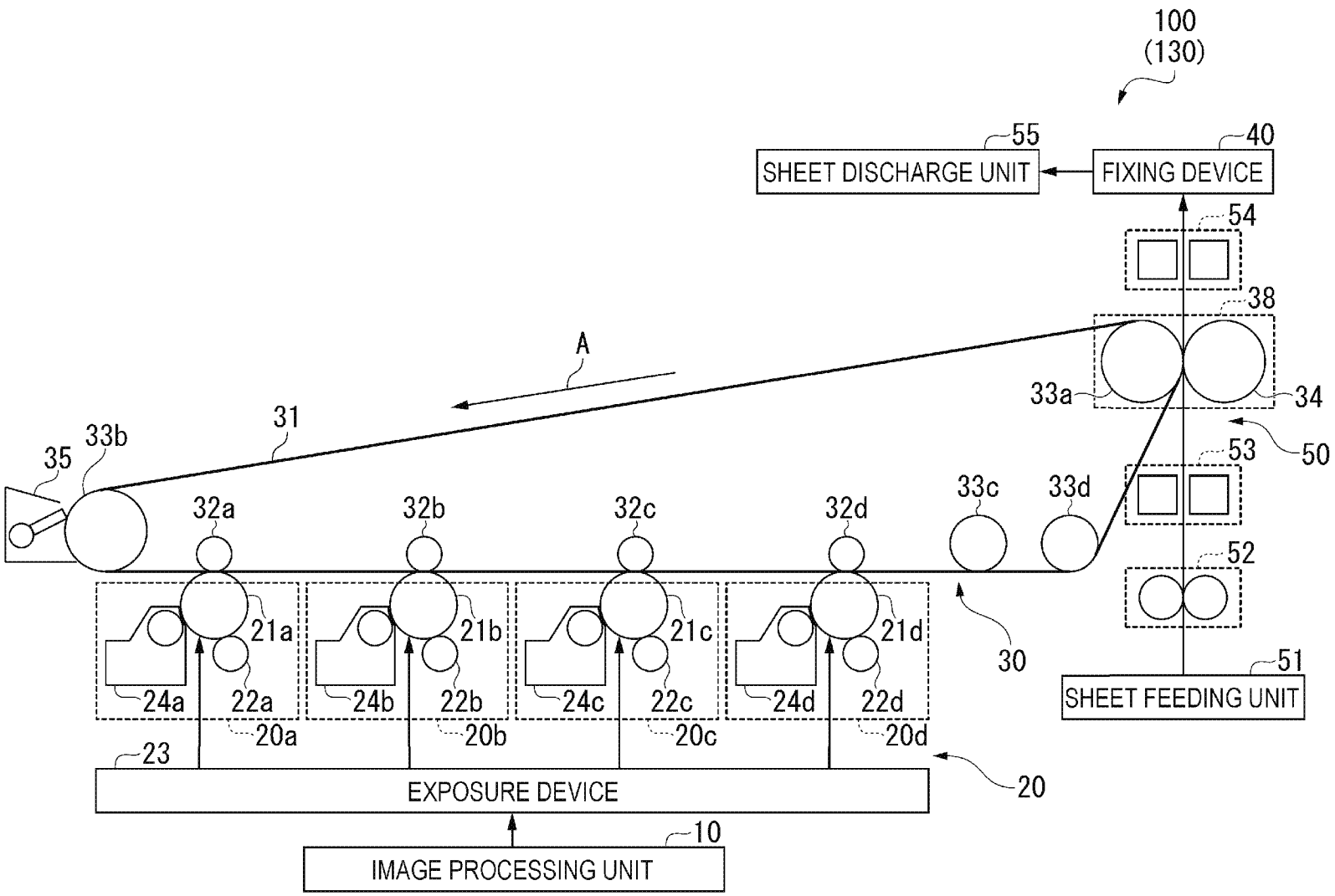
FIG. 2 is a view showing an example of an internal configuration of the image forming apparatus.

FIG. 2 is a view showing an example of an internal configuration of the image forming apparatus 100. As shown in FIG. 2, the image forming apparatus 100 (printer 130) includes four image forming units 20*a* to 20*d* in parallel. The image forming apparatus 100 is a so-called quadruple tandem type image forming apparatus. The image forming apparatus 100 includes an image processing unit 10, image forming units 20 (20*a* to 20*d*), an intermediate transfer unit 30, a fixing device 40, and a sheet conveying unit 50.

The image processing unit 10 inputs image information. The image information to be input is image information generated by the image reading unit 150 or image information transmitted from another apparatus. The image processing unit 10 performs digital image processing in which the input image information is processed in accordance with initial settings or user settings. For example, digital image processing includes tone correction based on tone correction data. In addition to tone correction, digital image processing includes processing such as color correction, shading correction, and various types of correction on input image data, as well as processing such as compression.

Next, the image forming units 20 (image forming units 20*a* to 20*d*) will be described. The image forming unit 20 includes an image forming unit 20*a* corresponding to yellow (Y), an image forming unit 20*b* corresponding to magenta (M), an image forming unit 20*c* corresponding to cyan (C), and an image forming unit 20*d* corresponding to black (K). Each of the image forming units 20*a* to 20*d* includes photoconductive drums 21*a* to 21*d*, chargers 22*a* to 22*d*, an exposure device 23, developing devices 24*a* to 24*d*, and a drum cleaning device (not shown). In the following description, the symbols "a" to "d" are omitted.

The photoconductive drum 21 is, for example, a chargeable organic photoconductive body (OPC: organic photoconductor) in which an undercoat layer, a charge generation layer, and a charge transport layer are sequentially laminated on the circumferential surface of a conductive cylindrical body made of aluminum. The photoconductive drum 21 is photoconductive.

The charger 22 generates a corona discharge. The charger 22 uniformly charges the surface of the photoconductive drum 21.

The exposure device 23 is, for example, a semiconductor laser. The exposure device 23 irradiates the photoconductive drum 21 with a laser beam corresponding to an image of each color component. When the laser light is irradiated by the exposure device 23, the potential of the area of the surface of the photoconductive drum 21 where the laser light is irradiated changes. An electrostatic latent image is formed on the surface of the photoconductive drum 21 by the change in the potential (potential difference).

The developing device 24 contains a developer. The developing device 24 adheres the toner of each color component to the surface of the photoconductive drum 21. Thus, a toner image is formed on the photoconductive drum 21. That is, the electrostatic latent image formed on the surface of the photoconductive drum 21 is visualized.

Here, the developer will be described. A two-component developer is used as the developer. The two-component developer has nonmagnetic toner and a carrier. As the carrier, for example, iron powder having a particle diameter of several tens of μm or polymer ferrite particles are used. The carrier is mixed with the toner in the developing device 24 and is frictionally charged to give the toner a charge (for example, a negative charge). Further, the carrier conveys the toner to the electrostatic latent image portion by a magnetic force. However, the developer is not limited to the two-component developer, and it is also possible to use a one-component developer that does not use a carrier.

The drum cleaning device (not shown) includes a cleaning blade in contact with the surface of the photoconductive drum 21. The cleaning blade removes residual toner remaining on the surface of the photoconductive drum 21 after the primary transfer. The removed residual toner is collected in the accommodation unit of the drum cleaning device.

Next, the intermediate transfer unit 30 will be described. The intermediate transfer unit 30 includes an intermediate transfer body 31, a primary transfer roller 32, a plurality of support rollers 33, a secondary transfer roller 34, a belt cleaning device 35, and the like.

The intermediate transfer body 31 is, for example, an endless belt. The intermediate transfer body 31 has conductivity and elasticity.

The support rollers 33*a* to 33*d* support the intermediate transfer body 31 so that tension is applied to the intermediate transfer body 31. Thus, the intermediate transfer body 31 is formed in a loop shape. One of the plurality of support rollers 33*a* to 33*d* (for example, the support roller 33*a*) is a driving roller. Rollers other than the drive roller are driven rollers. The intermediate transfer body 31 travels at a predetermined speed in an A direction as the driving roller rotates.

Here, the direction in which the intermediate transfer body 31 moves can be defined as an upstream direction and a downstream direction. Specifically, the direction in which the intermediate transfer body 31 moves can be defined with the image forming unit 20*a* as the most upstream and the belt cleaning device 35 as the most downstream.

The primary transfer roller 32 is disposed to face the photoconductive drum 21 via the intermediate transfer body 31. Specifically, the primary transfer roller 32 is disposed such that pressure is applied to the photoconductive drum 21 with the intermediate transfer body 31 interposed therebetween. Thus, a primary transfer portion for nipping the intermediate transfer body 31 is formed by the primary transfer roller 32 and the photoconductive drum 21.

When the intermediate transfer body 31 passes through the primary transfer portion, the toner image formed on the photoconductive drum 21 is transferred onto the intermediate transfer body 31. When the intermediate transfer body 31 passes through the primary transfer portion, a primary transfer bias is applied to the primary transfer roller 32. Specifically, a charge of the reverse polarity (positive polarity) to the toner is applied to the primary transfer roller 32. Thereby, the toner image formed on the photoconductive drum 21 is electrostatically transferred to the intermediate transfer belt 421.

The secondary transfer roller 34 is disposed to face the support roller 33*a* via the intermediate transfer body 31. Specifically, the secondary transfer roller 34 is disposed such that pressure is applied to the support roller 33*a* with the intermediate transfer body 31 interposed therebetween.

Thereby, a secondary transfer portion 38 which nips the intermediate transfer body 31 and the sheet is formed by the secondary transfer roller 34 and the support roller 33*a*.

When the sheet passes through the secondary transfer portion 38, the toner image on the intermediate transfer body 31 is transferred onto the sheet. When the sheet passes through the secondary transfer portion 38, a secondary transfer bias is applied to the support roller 33*a*. Specifically, a charge of the same polarity (negative polarity) as that of the toner is applied to the support roller 33*a*.

As a result, the toner image on the intermediate transfer body 31 is electrostatically transferred to the sheet. The secondary transfer roller 34 and the support roller 33*a* are configured to be separated. Thus, when a sheet is clogged in the secondary transfer portion 38, the user can remove the sheet.

The belt cleaning device 35 includes a cleaning blade in contact with the surface of the intermediate transfer body 31. The cleaning blade removes residual toner remaining on the surface of the intermediate transfer body 31 after the secondary transfer. The removed residual toner is collected in the accommodation unit of the belt cleaning device 35.

The fixing device 40 heats and presses the sheet on which the toner image is transferred. Thus, the fixing device 40 fixes the toner image on the sheet. The fixing device 40 can also adopt a method of fixing a toner image on a sheet by heating through a film-like member.

Next, the sheet conveying unit 50 will be described. The sheet conveying unit 50 includes a sheet feeding unit 51, a registration unit 52, a first guide unit 53, a second guide unit 54, and a sheet discharge unit 55.

The sheet feeding unit 51 conveys the sheets accommodated in the sheet accommodation unit 140 to the registration unit 52 one by one. The registration unit 52 stops the sheet conveyed from the sheet feeding unit 51 and feeds the sheet to the secondary transfer portion 38 at a predetermined timing. The predetermined timing is a timing at which the toner image formed on the intermediate transfer body 31 is secondarily transferred.

The first guide unit 53 regulates the conveyance direction of the sheet fed from the registration unit 52 and feeds the sheet to the secondary transfer portion 38. When the secondary transfer portion 38 transfers the toner image to the sheet regulated by the first guide unit 53, the secondary transfer portion 38 feeds the sheet to the fixing device 40. The fixing device 40 heats and presses the sheet fed from the secondary transfer portion 38 and feeds the sheet to the sheet discharge unit 55.

The second guide unit 54 regulates the conveyance direction of the sheet fed from the fixing device 40 to the sheet discharge unit 55. The sheet discharge unit 55 feeds the sheet to a discharge tray.

Next, the bias applied to the support roller 33*a* of the secondary transfer portion 38 will be described. As described above, a secondary transfer bias of negative polarity is applied to the support roller 33*a* at the timing of secondary transfer. In addition to the secondary transfer bias, a suppression bias, a resistance detection bias, a cleaning bias, and the like are applied to the support roller 33*a*.

The suppression bias is a bias that suppresses transfer of the toner on the intermediate transfer body 31 to the secondary transfer roller 34 or the like. The suppression bias is a bias of the reverse polarity (positive polarity) to the toner charged with the negative polarity. The suppression bias is applied, for example, at a timing at which secondary transfer is not performed.

The suppression bias includes, for example, a first suppression bias and a second suppression bias. The first suppression bias is, for example, a bias applied in an interval between sheets of paper in continuous printing, after a series of printing operations are completed, and the like.

The second suppression bias is a positive polarity bias for suppressing transfer of the toner image to the secondary transfer roller 34 or the like when performing a calibration operation. The calibration operation is, for example, various adjustments such as alignment. In the calibration operation, a patch image is formed on the intermediate transfer body 31. The second suppression bias is a bias for suppressing transfer of the patch image to the secondary transfer roller 34 or the like. The second suppression bias is a bias that prevents the toner image formed on the intermediate transfer body 31 from being transferred to the secondary transfer roller 34, and thus is a bias larger than the first suppression bias.

The resistance detection bias is a negative bias for detecting the load resistance of the secondary transfer roller 34. The resistance detection bias is, for example, a bias applied when printing the first sheet. The secondary transfer portion 38 applies a secondary transfer bias according to the detected load resistance. Thus, the secondary transfer portion 38 can apply an appropriate secondary transfer bias. The resistance detection bias is applied while the secondary transfer roller 34 makes one rotation.

The cleaning bias is a bias applied when cleaning (recovering) the residual toner transferred to the secondary transfer roller 34. The cleaning bias is applied, for example, by switching a negative bias of the same polarity as that of the toner and a bias of the reverse polarity (positive polarity) to the toner.

Here, in the present embodiment, the cleaning processing includes first cleaning processing and second cleaning processing having a higher cleaning ability than the first cleaning processing. In the first cleaning processing, a first cleaning bias is applied. In the second cleaning processing, a second cleaning bias larger than the first cleaning bias is applied.

The first cleaning bias includes a first cleaning bias of positive polarity and a first cleaning bias of negative polarity. The second cleaning bias includes a second cleaning bias of positive polarity and a second cleaning bias of negative polarity. The value of the second cleaning bias is the value of the bias in the original cleaning processing.

First, the second cleaning processing will be described. The second cleaning processing is original cleaning processing performed at a predetermined timing. The predetermined timing is, for example, a timing at which a series of printing operations are completed, a timing after power on, and the like. The second cleaning processing may be performed a plurality of times depending on the degree of adhesion of the residual toner.

A period during which the second cleaning bias of positive polarity is applied is a period during which the secondary transfer roller 34 makes one rotation. As a result, the toner of negative polarity attached to the secondary transfer roller 34 can be collected on the intermediate transfer belt. Similarly, a period during which the second cleaning bias of negative polarity is applied is a period during which the secondary transfer roller 34 makes one rotation. Thus, the toner of positive polarity attached to the secondary transfer roller 34 can be collected to the intermediate transfer belt.

Next, the first cleaning processing will be described. The first cleaning processing is simple cleaning processing performed between printing operations (for example, an interval between sheets of paper). The magnitude of the first cleaning bias is smaller than the magnitude of the second cleaning bias. Specifically, the value of the first cleaning bias of positive polarity is, for example, the same value as the second suppression bias. Also, the value of the first cleaning bias of negative polarity is, for example, the same value as the resistance detection bias.

Figure 3:
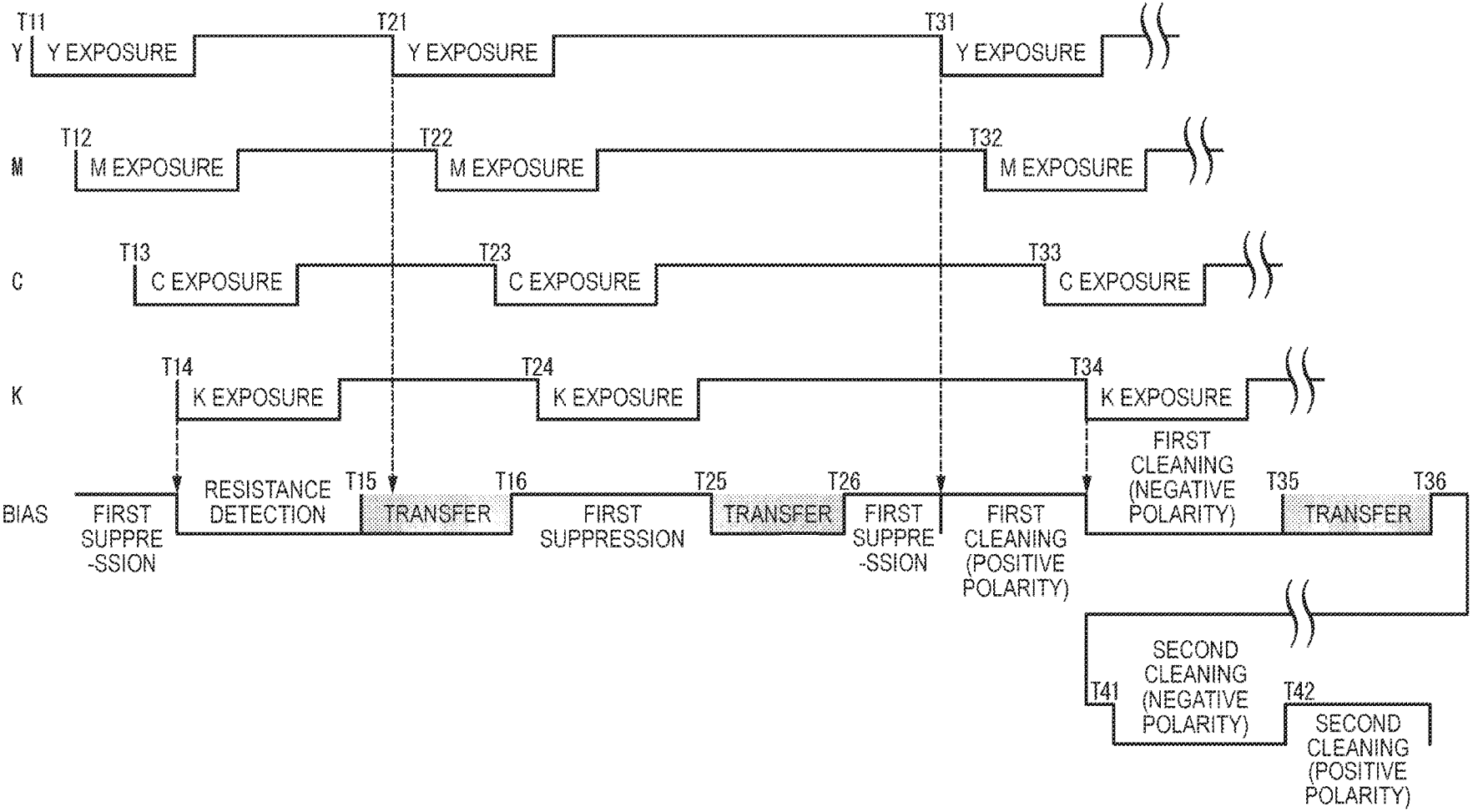
FIG. 3 is a view showing an example of a relationship between an exposure timing and a bias applied to a support roller.

FIG. 3 is a view showing an example of the relationship between the exposure timing and the bias applied to the support roller 33*a*. In FIG. 3 and the following drawings, first cleaning is described as "first cleaning", and second cleaning is described as "second cleaning".

Y, M, C, and K shown in FIG. 3 indicate the exposure of each color. Exposure to the photoconductive drum 21 by the exposure device 23 is performed in the order of Y→M→C→K. Further, "bias" shown in FIG. 3 indicates a bias applied to the support roller 33*a*. The "bias" in FIG. 3 indicates that the portion convex upward is the application of positive polarity, and the portion convex downward is the application of negative polarity.

In FIG. 3, continuous printing will be described as an example. A timing T11 is an exposure timing after the reading of a first original document in the continuous effect is completed. Specifically, the timing T11 is a timing at which yellow exposure (Y exposure) is performed. Before and after the start of Y exposure, the first suppression bias is applied to the support roller 33*a*.

A timing T12 is a timing at which magenta exposure (M exposure) is performed. A timing T13 is a timing at which cyan exposure (C exposure) is performed. At the timings T12 and T13, the first suppression bias is continuously applied to the support roller 33*a*.

A timing T14 is a timing at which black exposure (K exposure) is performed. The application of the first suppression bias ends at the timing at which the K exposure is performed. Then, a resistance detection bias is applied.

A timing T15 is a timing at which secondary transfer is performed. Specifically, the timing T15 is a timing at which the secondary transfer bias is applied. With the secondary transfer started at the timing T15, the toner image formed based on the exposure at the timings T11 to T14 is transferred to the sheet.

Further, a timing T16 is a timing at which secondary transfer is completed. At the timing T16, the first suppression bias is applied again.

Next, a case where the image forming apparatus 100 completes reading a second original document in the continuous effect and an exposure timing comes will be described. A timing T21 is a timing at which Y exposure is performed. When secondary transfer is performed at the timing at which Y exposure is performed, the secondary transfer bias is continuously applied as it is.

A timing T22 is a timing at which M exposure is performed. A timing T23 is a timing at which C exposure is performed. A timing T24 is a timing at which K exposure is performed. A timing T25 is a timing at which secondary transfer is performed. Specifically, the timing T25 is a timing at which the secondary transfer bias is applied. With the secondary transfer started at the timing T25, the toner image formed based on the exposure at the timings T21 to T24 is transferred to the sheet. A timing T26 is a timing at which the secondary transfer is completed. At the timing T26, the first suppression bias is applied again.

Next, a case where the image forming apparatus 100 completes reading a third original document in the continuous effect and an exposure timing comes will be described. A timing T31 is a timing at which Y exposure is performed. When the secondary transfer is not performed at the timing at which the Y exposure is performed, the first cleaning processing is performed. Specifically, at the timing T31 at which Y exposure is performed, the first cleaning bias of negative polarity is applied. The value of the first cleaning bias of negative polarity is, for example, the same value as the value of the second suppression bias.

A timing T32 is a timing at which M exposure is performed. A timing T33 is a timing at which C exposure is performed. A timing T34 is a timing at which K exposure is performed. When the K exposure is performed, the application of the first cleaning bias of positive polarity ends. Then, the first cleaning bias of negative polarity is applied. The value of the first cleaning bias of negative polarity is, for example, the same value as the value of the resistance detection bias.

A period during which the first cleaning bias of positive polarity is applied is a period (hereinafter, referred to as "Y→K period") from the start timing of Y exposure to the start timing of K exposure. If the "Y→K period" is longer than the period during which the secondary transfer roller 34 makes one rotation, the first cleaning processing of positive polarity can be performed in the period during which the secondary transfer roller 34 makes one rotation.

On the other hand, if the "Y→K period" is shorter than the period during which the secondary transfer roller 34 makes one rotation, the first cleaning processing of positive polarity cannot be performed in the period during which the secondary transfer roller 34 makes one rotation. For this reason, if the "Y→K period" is longer than the period during which the secondary transfer roller 34 makes one rotation, the cleaning efficiency of the first cleaning processing of positive polarity is improved.

Here, the "Y→K period" may be a fixed period or a variable period. Specifically, the "Y→K period" may be a fixed period predetermined by the design of each device. Also, the "Y→K period" may be a variable period when the exposure timing changes according to the image to be formed. Also, the "Y→K period" may be a variable period according to the use's operation. For example, the image forming apparatus 100 may receive setting changes between a normal mode in which the "Y→K period" is short and a cleaning mode in which the "Y→K period" is long and set the "Y→K period" as the time according to the setting.

The timing T34 is the start timing of the K exposure. The timing T34 is also the timing at which the first cleaning bias of negative polarity is applied. The value of the first cleaning bias of negative polarity is, for example, the same value as the value of the resistance detection bias. The period during which the first cleaning bias of negative polarity is applied is equivalent to or longer than the period during which the secondary transfer roller 34 makes one rotation.

A timing T35 is a timing at which secondary transfer is performed. Specifically, the timing T35 is a timing at which the secondary transfer bias is applied. With this secondary transfer, the toner image formed based on the exposure at the timings T31 to T34 is transferred to the sheet.

A timing T36 is a timing at which the secondary transfer is completed. At the timing T36, the first suppression bias is applied again. In the continuous printing, when the secondary transfer is not performed at the timing at which the Y exposure is performed, the first cleaning processing is repeatedly performed. If the first cleaning bias of positive polarity is not applied, the first cleaning bias of negative polarity is not applied at the timing of the K exposure.

Next, a case where the image forming apparatus 100 completes the last printing in the continuous effect will be described. A timing T41 is a timing at which the second cleaning processing is performed after a series of continuous printing is completed. The timing T41 is a timing at which the second cleaning bias of negative polarity is applied. The second cleaning bias of negative polarity is applied in a period during which the secondary transfer roller 34 makes one rotation. When the application of the second cleaning bias of negative polarity is completed, the second cleaning bias of positive polarity is applied.

A timing T42 is a timing at which the second cleaning bias of positive polarity is applied. The second cleaning bias of positive polarity is applied in a period during which the secondary transfer roller 34 makes one rotation. As described above, in the present embodiment, the image forming apparatus 100 can perform the first cleaning processing and the second cleaning processing in continuous printing.

Figure 4:
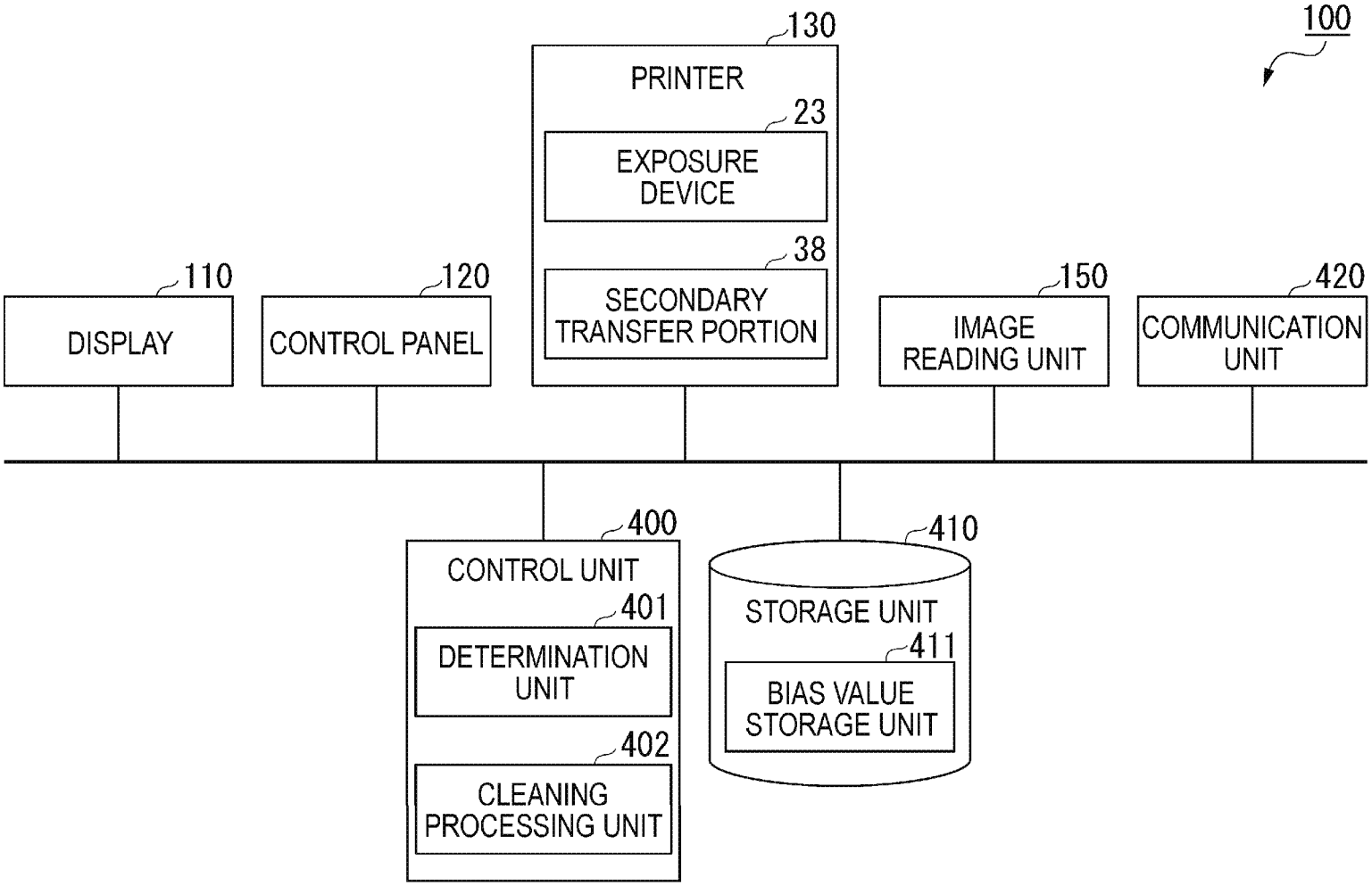
FIG. 4 is a view showing an example of a functional configuration of the image forming apparatus.

FIG. 4 is a view showing an example of a functional configuration of the image forming apparatus 100. As shown in FIG. 4, the image forming apparatus 100 includes the display 110, the control panel 120, the printer 130, the image reading unit 150, a communication unit 420, a control unit 400, and a storage unit 410.

The printer 130 includes the exposure device 23 and the secondary transfer portion 38. The communication unit 420 is an interface of a network. The communication unit 420 is connected to the network through a communication line. The communication unit 420 is connected to another information processing apparatus (for example, a personal computer, a smartphone, and the like) via the network. The communication unit 420 receives, for example, image information to be printed from another information processing apparatus.

The control unit 400 includes a determination unit 401 and a cleaning processing unit 402. The control unit 400 is realized by a processor. The control unit 400 functions as the determination unit 401 and the cleaning processing unit 402 when the processor executes a program.

The storage unit 410 includes a bias value storage unit 411. The storage unit 410 is realized by a storage device such as a magnetic hard disk drive or a semiconductor storage device.

The bias value storage unit 411 stores a bias value to be applied to the secondary transfer portion 38 (support roller 33*a*). The bias value is each bias value such as a secondary transfer bias, a first suppression bias, a second suppression bias, a resistance detection bias, and a second cleaning bias.

The magnitude relationship of the absolute value of each bias is represented as an example below by using an inequality sign.

Second cleaning bias≥resistance detection bias≥second suppression bias≥first suppression bias The second cleaning bias is a bias for pulling back the toner transferred to the secondary transfer roller 34. Therefore, the second cleaning bias may be the largest bias among the respective biases. The resistance detection bias and the second suppression bias may be a bias having a magnitude equal to or less than the second cleaning bias. The first suppression bias is a bias for causing the intermediate transfer body 31 to hold the toner image. Therefore, the first suppression bias may be a bias having a magnitude equal to or less than the second suppression bias.

The control unit 400 controls the secondary transfer portion 38 to apply the first suppression bias in a period during which the secondary transfer is not performed. The cleaning processing unit 402 applies the cleaning bias to the secondary transfer portion 38 to perform cleaning processing for removing the residual toner after the secondary transfer. The residual toner is the residual toner transferred to the secondary transfer roller 34 after the secondary transfer.

The cleaning processing of the secondary transfer portion 38 performed by the control unit 400 will be described below. The determination unit 401 determines at a predetermined timing whether or not the toner image based on the exposed electrostatic latent image is secondarily transferred. The predetermined timing is, for example, an exposure timing at which exposure is performed by the exposure device 23. Further, this determination is a determination as to whether or not the toner image based on the electrostatic latent image exposed prior to the exposure is secondarily transferred.

Here, the timing of the exposure and the timing of the secondary transfer of the toner image based on the exposure prior to the exposure will be specifically described. The following description of timing will be made with reference to FIG. 3 as appropriate.

At the timing T21 (timing of Y exposure for second sheet), secondary transfer of the toner image is performed based on the electrostatic latent image (electrostatic latent image of first sheet) exposed at the timings T11 to T14. For this reason, the determination unit 401 determines that secondary transfer is performed at the timing T21. The fact that secondary transfer is performed means that it is not an interval between sheets of paper.

Also, at the timing T31 (timing of Y exposure for third sheet), secondary transfer of the toner image is not performed based on the electrostatic latent image (electrostatic latent image of second sheet) exposed at the timings T21 to T24. For this reason, the determination unit 401 determines that secondary transfer is not performed at the timing T31. The fact that secondary transfer is not performed means that it is an interval between sheets of paper.

The cleaning processing unit 402 performs the first cleaning processing in accordance with the determination result of the determination unit 401. Specifically, when the determination unit 401 determines that the secondary transfer is performed, the cleaning processing unit 402 does not perform the first cleaning processing. That is, the cleaning processing unit 402 does not perform the first cleaning processing when it is not an interval between sheets of paper.

On the other hand, when the determination unit 401 determines that the secondary transfer is not performed, the control unit 400 performs the first cleaning processing until the subsequent processing is started. The subsequent processing is, for example, secondary transfer processing by the secondary transfer device (secondary transfer portion 38). Specifically, the subsequent processing is processing of detecting the load resistance of the secondary transfer roller 34. Although the details will be described later, the subsequent processing is performed at the timing of the K exposure in the case of the quadruple tandem type image forming apparatus 100.

The period until the subsequent processing is started, is, for example, an interval between sheets of paper. Further, the cleaning processing unit 402 performs the second cleaning processing of performing cleaning for a predetermined time at a timing different from the timing to perform the first cleaning processing. The predetermined time is a predetermined time from the timing at which the series of printing operations are completed and a predetermined time from the timing of power on.

The second cleaning processing may be performed at a timing when it is assumed that the possibility of toner transfer to the secondary transfer roller 34 is high. Specifically, the second cleaning processing may be performed, for example, at the timing at which a predetermined number of sheets (for example, several hundred sheets) is reached in continuous printing. The absolute value of the first cleaning bias is equal to or less than the absolute value of the second cleaning bias.

Next, the first cleaning bias of positive polarity will be described. In the present embodiment, the first cleaning bias of positive polarity is a bias that is initially applied in the first cleaning processing. Specifically, the first cleaning bias of positive polarity is applied at the exposure timing.

In the present embodiment, the exposure timing is the timing at which exposure is performed first among a plurality of colors. Specifically, the exposure timing is the timing of Y exposure at the timing T31. However, the exposure timing may be a timing (for example, timing of M exposure or timing of C exposure) at which exposure is performed for a second or the subsequent color among the plurality of colors.

In addition, in the present embodiment, the value of the first cleaning bias of positive polarity is the same value as the second suppression bias. However, the value of the first cleaning bias of positive polarity is not limited to the same value as the second suppression bias. For example, the value of the first cleaning bias of positive polarity may be the same value as the second cleaning bias of positive polarity.

Next, switching from the first cleaning bias of positive polarity to the first cleaning bias of negative polarity will be described. The first cleaning processing includes processing of switching the polarity of the cleaning bias at the timing at which exposure is performed last among the plurality of colors. Specifically, the first cleaning processing includes processing of switching to the first cleaning bias (resistance detection bias) of negative polarity at the timing of K exposure at the timing T34. The resistance detection of the secondary transfer roller 34 is a preliminary operation before applying the secondary transfer bias. Therefore, the cleaning processing unit 402 can perform the first cleaning processing of negative polarity along with the preliminary operation of the secondary transfer.

The plurality of colors on which the electrostatic latent image is formed is four colors of Y, M, C, and K. However, the plurality of colors is not limited to four, and may be two or more. In addition, the order of exposure of the plurality of colors is not limited to the order of Y, M, C, and K. For example, the image forming units 20*a* to 20*d* may be arranged in an order different from the order of Y, M, C, and K from the upstream side to the downstream side. When arranged in this manner, the order of exposure of the plurality of colors is the same as the order in which the image forming units 20*a* to 20*d* are arranged.

Next, the first cleaning bias of negative polarity will be described. The first cleaning bias of negative polarity is applied before the toner image based on the electrostatic latent image formed at the exposure timing is secondarily transferred. Specifically, the first cleaning bias of negative polarity is applied at a timing before the timing T35 at which the toner image based on the electrostatic latent image (electrostatic latent image of third sheet) formed at the timings T31 to T34 is secondarily transferred.

In the present embodiment, the first cleaning bias of negative polarity is applied for a period equal to or longer than the period during which the secondary transfer roller 34 makes one rotation. However, the first cleaning bias of negative polarity may be applied for a period shorter than the period during which the secondary transfer roller 34 makes one rotation.

The value of the first cleaning bias of negative polarity is the same value as the bias for detecting the load resistance of the secondary transfer roller 34. However, the value of the first cleaning bias of negative polarity is not limited to the same value as the bias for detecting the load resistance. For example, the value of the first cleaning bias of negative polarity may be the same value as the second cleaning bias of negative polarity.

Figure 5:
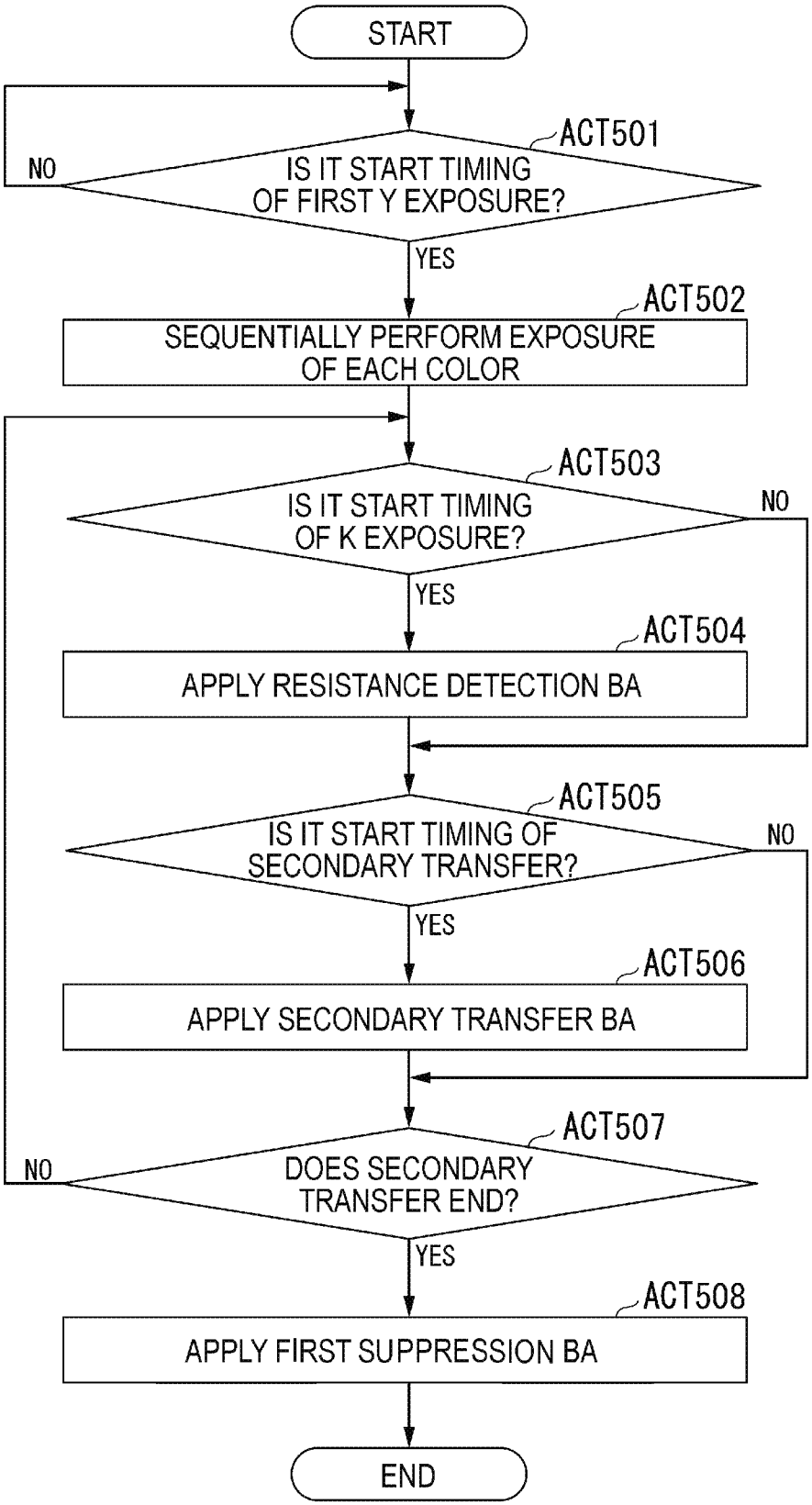
FIG. 5 is a flowchart showing an example of processing when printing a first sheet in continuous printing.

FIG. 5 is a flowchart showing an example of processing when printing a first sheet in continuous printing. "BA" shown in the drawings subsequent to FIG. 5 indicates "bias".

As shown in FIG. 5, the control unit 400 determines whether or not it is the start timing of the Y exposure for the first sheet (ACT 501). The control unit 400 stands by until the start timing of the first Y exposure of the first sheet (ACT 501: NO). When the start timing of the first Y exposure comes (ACT 501: YES), the control unit 400 controls the exposure device 23 to sequentially perform exposure of each color (ACT 502). This exposure is exposure of each color (Y, M, C) except K.

Then, the control unit 400 (determination unit 401) determines whether or not it is the start timing of the K exposure (ACT 503). If it is not the start timing of the K exposure (ACT 503: NO), the control unit 400 proceeds to ACT 505. If it is the start timing of the K exposure (ACT 503: YES), the control unit 400 applies the resistance detection bias to the secondary transfer portion 38 (support roller 33*a*) (ACT 504).

Then, the control unit 400 determines whether or not it is the start timing of the secondary transfer (ACT 505). If it is not the start timing of the secondary transfer (ACT 505: NO), the control unit 400 proceeds to ACT 507. If it is the start timing of the secondary transfer (ACT 505: YES), the control unit 400 applies the secondary transfer bias to the secondary transfer portion 38 (ACT 506).

Then, the control unit 400 determines whether or not the secondary transfer ends (ACT 507). If the secondary transfer does not end (ACT 507: NO), the control unit 400 returns to ACT 503. When the secondary transfer ends (ACT 507: YES), the control unit 400 applies the first suppression bias to the secondary transfer portion 38 (ACT 508) and ends the processing.

Figure 6:
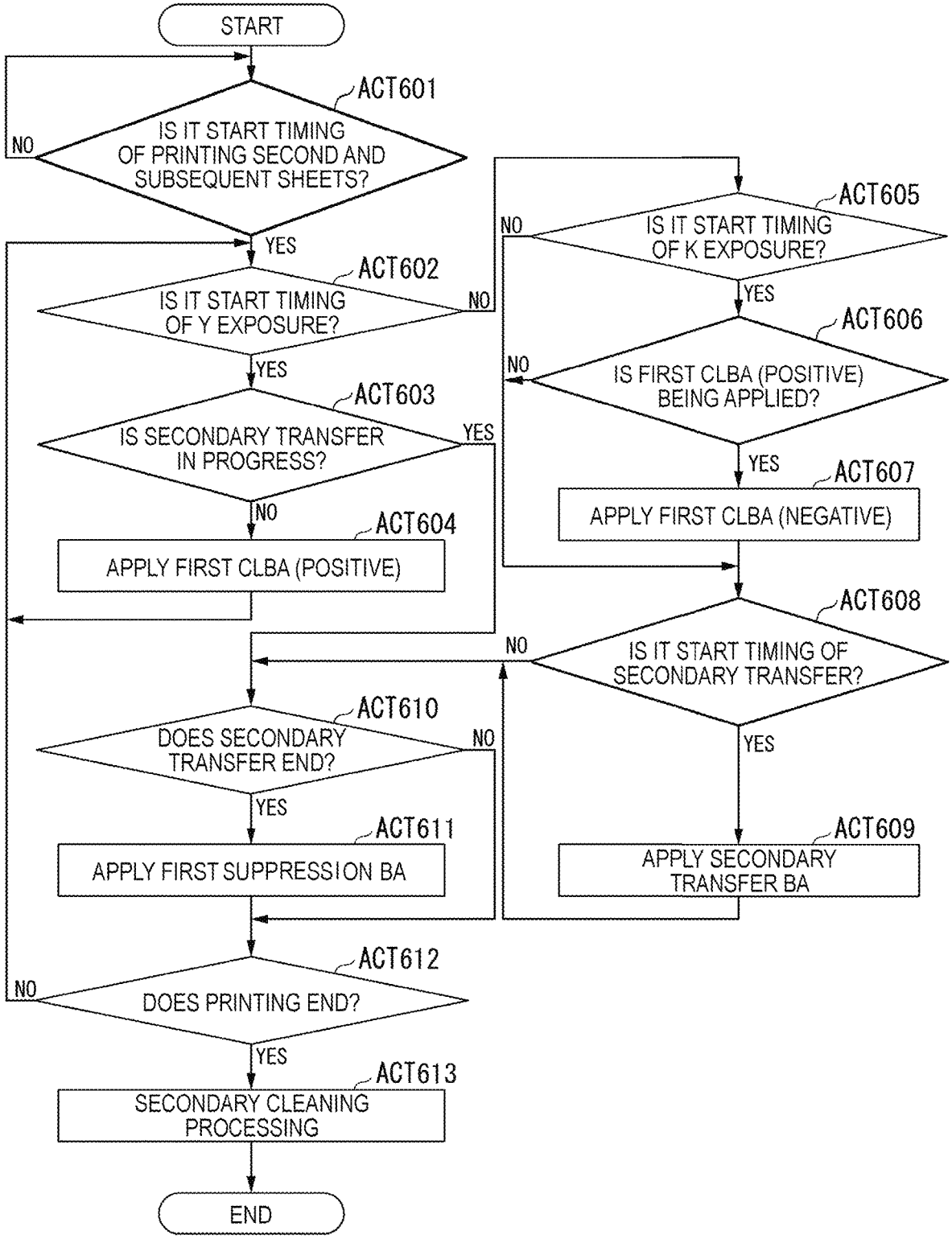
FIG. 6 is a flowchart showing an example of processing when printing second and subsequent sheets in continuous printing.

FIG. 6 is a flowchart showing an example of processing when printing second and subsequent sheets in continuous printing. "CLBA" shown in FIG. 6 indicates "cleaning bias".

As shown in FIG. 6, the control unit 400 determines whether or not it is the start timing of printing the second and subsequent sheets (ACT 601). The control unit 400 stands by until the start timing of printing the second and subsequent sheets (ACT 601: NO).

If it is the start timing of the second and subsequent sheets (ACT 601: YES), the control unit 400 determines whether or not it is the start timing of Y exposure (ACT 602). If it is the start timing of Y exposure (ACT 602: YES), the control unit 400 determines whether or not secondary transfer is in progress (ACT 603).

If secondary transfer is in progress (ACT 603: YES), the control unit 400 proceeds to ACT 610. When secondary transfer is not in progress (ACT 603: NO), the control unit 400 (cleaning processing unit 402) applies the first cleaning bias (second suppression bias) of positive polarity to the secondary transfer portion 38 (ACT 604) and returns to ACT 602.

In ACT 602, when it is not the start timing of Y exposure (ACT 602: NO), the control unit 400 determines whether or not it is the start timing of K exposure (ACT 605). If it is not the start timing of K exposure (ACT 605: NO), the control unit 400 proceeds to ACT 608.

If it is the start timing of K exposure (ACT 605: YES), the control unit 400 determines whether or not the first cleaning bias (second suppression bias) of the positive polarity is being applied (ACT 606). If the first cleaning bias of positive polarity is not being applied (ACT 605: NO), the control unit 400 proceeds to ACT 608.

When the first cleaning bias of positive polarity is being applied (ACT 605: YES), the control unit 400 (cleaning processing unit 402) applies the first cleaning bias (resistance detection bias) of negative polarity (ACT 607).

Then, the control unit 400 determines whether or not it is the start timing of the secondary transfer (ACT 608). If it is not the start timing of secondary transfer (ACT 608: NO), the control unit 400 proceeds to ACT 610. If it is the start timing of secondary transfer (ACT 608: YES), the control unit 400 applies the secondary transfer bias (ACT 609).

Then, the control unit 400 determines whether or not it is the end timing of the secondary transfer (ACT 610). If it is not the end timing of the secondary transfer (ACT 610: NO), the control unit 400 proceeds to ACT 612. If it is the end timing of the secondary transfer (ACT 610: YES), the control unit 400 applies the first suppression bias (ACT 611).

Then, the control unit 400 determines whether or not a series of continuous printing ends (ACT 612). If the series of continuous printing does not end (ACT 612: NO), the control unit 400 returns to ACT 602. If a series of continuous printing is completed (ACT 612: YES), the control unit 400 (cleaning processing unit 402) performs the second cleaning processing (ACT 613) and ends the processing.

As described above, when the toner image based on the exposed electrostatic latent image is not secondarily transferred at a predetermined timing, the image forming apparatus 100 performs the first cleaning processing until the subsequent processing is started. Therefore, the image forming apparatus 100 can clean the secondary transfer roller 34 within a limited time after exposure, even if the secondary transfer roller 34 cannot secure a period of one or more rotations. That is, the image forming apparatus 100 can perform the cleaning without providing a period for cleaning. For this reason, even if the image forming apparatus 100 cannot perform cleaning for one rotation of the secondary transfer roller 34 (for example, even for only half a rotation), the image forming apparatus 100 can perform simple cleaning in the middle of printing. Therefore, the image forming apparatus 100 can efficiently perform cleaning between sheets of paper in continuous printing. Further, the image forming apparatus 100 can perform the cleaning without decreasing the printing efficiency.

Further, the control unit 400 performs the second cleaning processing for a predetermined time at a timing different from the timing at which the first cleaning processing is performed. Therefore, even if the residual toner cannot be removed in the first cleaning processing, the image forming apparatus 100 can remove the residual toner in the second cleaning processing. Therefore, the image forming apparatus 100 can perform cleaning more efficiently.

Further, the absolute value of the bias applied in the first cleaning processing is equal to or less than the absolute value of the bias applied in the second cleaning processing. Therefore, the image forming apparatus 100 can more efficiently remove the residual toner that could not be removed in the first cleaning processing in the second cleaning processing.

Also, the first cleaning bias of negative polarity is applied for a period equal to or longer than the period during which the secondary transfer roller 34 makes one rotation. In addition, the first cleaning bias of negative polarity is applied before the toner image based on the electrostatic latent image formed at the exposure timing is secondarily transferred. Thus, the image forming apparatus 100 can collect the toner of positive polarity transferred to the secondary transfer roller 34 to the intermediate transfer body 31 before performing the secondary transfer of the toner image.

Further, the subsequent processing is secondary transfer processing by the secondary transfer portion 38. Thus, the image forming apparatus 100 can perform simple cleaning in a gap time before starting the secondary transfer processing.

Further, the subsequent processing is processing for detecting the load resistance of the secondary transfer roller 34. As a result, the image forming apparatus 100 can perform simple cleaning in a gap time before the processing of detecting the load resistance.

Further, the value of the first cleaning bias of the negative polarity is the same value as the resistance detection bias for detecting the load resistance of the secondary transfer roller 34. Thus, the image forming apparatus 100 can clean the secondary transfer roller 34 in accordance with a resistance detection operation performed as a preparation operation for the secondary transfer. Therefore, the image forming apparatus 100 can perform the cleaning efficiently. Further, the image forming apparatus 100 can divert the resistance detection bias to the first cleaning bias of negative polarity. Therefore, the image forming apparatus 100 does not have to newly store and set the value of the first cleaning bias of negative polarity. Therefore, the image forming apparatus 100 can simplify the processes in a manufacturing stage and a development stage.

Further, the timing to determine whether or not the toner image based on the exposed electrostatic latent image is secondarily transferred is the exposure timing. Therefore, simple cleaning can be performed between the exposure timing and the start of the subsequent processing.

In addition, the first cleaning processing includes processing of first applying the first cleaning bias of positive polarity at an exposure timing. Therefore, the image forming apparatus 100 can continuously apply the first cleaning bias having the same polarity as the first suppression bias with the application of the first suppression bias. Therefore, the image forming apparatus 100 can efficiently collect toner of negative polarity.

Further, the exposure timing that is the start timing of the first cleaning processing is the timing at which the exposure is performed first among the plurality of colors. Thus, the image forming apparatus 100 can start the cleaning at the timing at which the exposure is performed on the most upstream side. Therefore, the image forming apparatus 100 can extend the cleaning period related to the first cleaning processing. Therefore, the image forming apparatus 100 can perform cleaning more efficiently.

In addition, the first cleaning processing includes processing of switching the polarity of the first cleaning bias at the timing at which the exposure is performed last among the plurality of colors. Specifically, the image forming apparatus 100 switches the first cleaning bias to the negative polarity at the timing of K exposure. Therefore, the image forming apparatus 100 can clean the secondary transfer roller 34 in preparation for the secondary transfer. Therefore, the cleaning can be performed efficiently without decreasing the printing efficiency.

The first cleaning processing is processing performed when continuous printing is performed. Therefore, the image forming apparatus 100 can perform simple cleaning within a limited time without securing a cleaning period during continuous printing. Therefore, the image forming apparatus 100 can efficiently perform cleaning in continuous printing without decreasing the printing efficiency of continuous printing.

In addition, the first cleaning processing is processing of applying the cleaning bias larger than the first suppression bias. Therefore, the image forming apparatus 100 can more efficiently collect the toner of negative polarity transferred to the secondary transfer roller 34 at the exposure timing.

Further, the value of the first cleaning bias of positive polarity is the same value as the second suppression bias. Thus, the image forming apparatus 100 can divert the second suppression bias to the first cleaning bias of positive polarity. Therefore, the image forming apparatus 100 does not have to newly store and set the value of the first cleaning bias of positive polarity. Therefore, the image forming apparatus 100 can simplify the processes in a manufacturing stage and a development stage.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image carrier;

an exposure device configured to expose the image carrier to form an electrostatic latent image on the image carrier;

a developing device configured to form a toner image by adhering toner to the electrostatic latent image;

a primary transfer device configured to primarily transfer the toner image to a transfer body;

a secondary transfer device configured to use a transfer roller to secondarily transfer the toner image primarily transferred onto the transfer body to a recording medium when a transfer bias is applied to the secondary transfer device; and a control unit configured to apply a cleaning bias to the secondary transfer device to remove residual toner after the secondary transfer, wherein:

the control unit is configured to determine, at a predetermined timing, if the toner image is being secondarily transferred;

in response to the control unit determining that the toner image is not being secondarily transferred at the predetermined timing, the control unit is configured to perform a first cleaning process until a process for detecting a load resistance of the transfer roller is started;

the first cleaning process includes a process of applying a cleaning bias of the same polarity as a polarity of the toner; and a value of the cleaning bias of the same polarity is the same value as a bias for detecting the load resistance.

2. The image forming apparatus of claim 1, wherein the control unit is configured to perform a second cleaning process for a predetermined period of time at a timing different from the timing at which the first cleaning process is performed.

3. The image forming apparatus of claim 2, wherein a magnitude of the cleaning bias applied in the first cleaning process is equal to or less than a magnitude of a bias applied in the second cleaning process.

4. The image forming apparatus of claim 1, wherein the predetermined timing is an exposure timing at which an exposure is performed by the exposure device.

5. The image forming apparatus of claim 4, wherein the exposure device is configured to sequentially perform a series of exposures each corresponding to one of a series of different colors, and wherein the exposure device forms an electrostatic latent image in each exposure; and wherein the exposure timing is a timing at which the exposure corresponding to the first color of the series of different colors is performed.

6. The image forming apparatus of claim 5, wherein the first cleaning process includes switching the polarity of the cleaning bias at a timing at which the exposure corresponding to the last color of the series of different colors is performed.

7. The image forming apparatus of claim 1, wherein the first cleaning process is performed while continuous printing is performed.

8. An image forming apparatus comprising:

an image carrier;

an exposure device configured to expose the image carrier to form an electrostatic latent image on the image carrier;

a developing device configured to form a toner image by adhering toner to the electrostatic latent image;

a primary transfer device configured to primarily transfer the toner image to a transfer body;

a secondary transfer device configured to secondarily transfer the toner image primarily transferred onto the transfer body to a recording medium when a transfer bias is applied to the secondary transfer device; and a control unit configured to apply a cleaning bias to the secondary transfer device to remove residual toner after the secondary transfer, wherein:

the exposure device is configured to sequentially perform a series of exposures each corresponding to one of a series of different colors, the exposure device forming an electrostatic latent image in each exposure;

the control unit is configured to determine, at an exposure timing at which the exposure corresponding to the first color of the series of different colors is performed, if the toner image is being secondarily transferred;

in response to the control unit determining that the toner image is not being secondarily transferred at the exposure timing, the control unit is configured to perform a first cleaning process until a subsequent process is started; and the first cleaning process includes switching the polarity of the cleaning bias at a timing at which the exposure corresponding to the last color of the series of different colors is performed.

9. The image forming apparatus of claim 8, wherein the control unit is configured to perform a second cleaning process for a predetermined period of time at a timing different from the timing at which the first cleaning process is performed.

10. The image forming apparatus of claim 9, wherein a magnitude of a bias applied in the first cleaning process is equal to or less than a magnitude of a bias applied in the second cleaning process.

11. The image forming apparatus of claim 8, wherein the subsequent process is a secondary transfer process performed by the secondary transfer device.

12. The image forming apparatus of claim 8, wherein the secondary transfer device performs the secondary transfer using a transfer roller; and wherein the subsequent process is a process for detecting a load resistance of the transfer roller.

13. The image forming apparatus of claim 12, wherein the first cleaning process includes a process of applying a cleaning bias of the same polarity as a polarity of the toner; and wherein a value of the cleaning bias of the same polarity is the same value as a bias for detecting the load resistance.

14. The image forming apparatus of claim 8, wherein the first cleaning process is performed while continuous printing is performed.

* * * * *